US011177606B2

(12) United States Patent
Bell

(10) Patent No.: US 11,177,606 B2
(45) Date of Patent: Nov. 16, 2021

(54) HOUSING WITH LATERAL HOOKS

(71) Applicant: HEWLETT-PACKARD DEVELOPMENT COMPANY, L.P., Spring, TX (US)

(72) Inventor: Jeffrey F Bell, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 56 days.

(21) Appl. No.: 16/637,015

(22) PCT Filed: Sep. 22, 2017

(86) PCT No.: PCT/US2017/052911

§ 371 (c)(1),
(2) Date: Feb. 6, 2020

(87) PCT Pub. No.: WO2019/059923

PCT Pub. Date: Mar. 28, 2019

(65) Prior Publication Data

US 2020/0243999 A1 Jul. 30, 2020

(51) Int. Cl.

| | |
|---|---|
| ***H01R 13/46*** | (2006.01) |
| ***B41J 2/14*** | (2006.01) |
| ***H01R 12/70*** | (2011.01) |
| ***H01R 12/72*** | (2011.01) |
| ***H01R 12/79*** | (2011.01) |
| ***H01R 13/629*** | (2006.01) |

(52) U.S. Cl.

CPC ..... *H01R 13/46* (2013.01); *B41J 2/1433* (2013.01); *H01R 12/7052* (2013.01); *H01R 12/721* (2013.01); *H01R 12/79* (2013.01); *H01R 13/62966* (2013.01); *H01R 13/62983* (2013.01); *H01R 13/62988* (2013.01); *B41J 2002/14491* (2013.01)

(58) Field of Classification Search

CPC ..... B41J 2002/14491; B41J 2/1433; H01R 13/641; H01R 13/62988; H01R 13/62983; H01R 13/62966; H01R 13/46; H01R 12/79; H01R 12/721; H01R 12/7052

USPC ..... 439/55, 157, 325, 327–329, 345, 358, 439/372, 492, 493

See application file for complete search history.

(56) References Cited

U.S. PATENT DOCUMENTS

| | | | | |
|---|---|---|---|---|
| 3,740,698 A * | 6/1973 | Jerominek | ..... | H01R 12/78 439/61 |
| 4,726,775 A * | 2/1988 | Owen | ..... | H01R 29/00 439/188 |
| 6,305,959 B1 | 10/2001 | Baker et al. | | |
| 6,817,892 B2 * | 11/2004 | Sakai | ..... | H01R 12/78 439/495 |

(Continued)

OTHER PUBLICATIONS

Pin Strip PCB Connector for Two-piece Electronics Housings, Retrieved From Internet Jul. 2017, https://www.phoenixcontact com/online/portal/pi?1dmy&urile=wcm%3Apath%3A/pien/web/main/products/subcategory_pages/pcb_plug-in_connectors_p-11-02/920a10cd-c14a-422b-9cca-5f175f2cb590/920a10cd-c14a-422b-9cca-5f17Sf2cb590.

*Primary Examiner* — Travis S Chambers
(74) *Attorney, Agent, or Firm* — Fabian VanCott

(57) ABSTRACT

A fluid ejection device, in an example, that includes a housing with the housing including a plurality of lateral hooks to engage with a plurality of posts of a connector, the lateral hooks running, at least partially, parallel to a cable receiving surface wherein a portion of a printed circuit board (PCB) comprising electrical interconnects extends beyond the cable receiving surface to interface with the connector.

18 Claims, 9 Drawing Sheets

(56) References Cited

U.S. PATENT DOCUMENTS 6,874,872 B2 4/2005 Lewis et al.
6,942,514 B1 * 9/2005 Cheng ..... H01R 12/7029 439/328
6,999,321 B2 2/2006 Suekawa et al.
7,189,121 B1 * 3/2007 Ko ..... H01R 13/6275 439/328
7,559,772 B2 * 7/2009 Tsai ..... H01R 12/592 439/495
7,955,112 B2 * 6/2011 Yang ..... H01R 12/7023 439/328
8,376,519 B2 * 2/2013 Silverbrook ..... B41J 2/17553 347/49
8,500,486 B2 8/2013 Buck et al.
8,579,654 B2 11/2013 Chen et al.
9,565,780 B2 * 2/2017 Nishio ..... H05K 5/0069
9,585,278 B2 * 2/2017 Dobler ..... H05K 3/301
9,710,421 B2 * 7/2017 Tamarkin ..... G06F 13/409
10,000,009 B2 * 6/2018 Maier ..... B29C 64/106
10,096,944 B2 * 10/2018 Huang ..... H01R 13/6582
10,239,314 B2 * 3/2019 Fujisawa ..... B41J 2/04541
10,312,615 B2 * 6/2019 Liu ..... H01R 12/79
10,320,100 B2 * 6/2019 Phillips ..... H01R 13/6278
10,454,194 B1 * 10/2019 Phillips ..... H01R 13/629
10,513,076 B1 * 12/2019 Freakes ..... B33Y 30/00
10,576,739 B2 * 3/2020 Yamada ..... B41J 2/0451
10,651,575 B2 * 5/2020 Henry ..... H01R 12/721
10,680,363 B2 * 6/2020 Phillips ..... H01R 12/721
2006/0030171 A1 * 2/2006 Hung ..... H05K 1/118 439/67
2013/0040482 A1 * 2/2013 Ngo ..... H01R 12/7023 439/328
2013/0059458 A1 * 3/2013 Chang ..... H01R 12/7029 439/328
2017/0008283 A1 1/2017 Sherman et al.
2017/0170600 A1 6/2017 Tezgurler
2018/0297271 A1 * 10/2018 Maier ..... B29C 64/259

* cited by examiner

HOUSING WITH LATERAL HOOKS

BACKGROUND

Electrical interfaces may be any electro-mechanical device used to join electrical terminations and create an electrical circuit. In some examples, electrical interfaces provide for the coupling of a number of electric devices such as computing devices to one another, and may use any of a large number of electrical interface standards. These electrical interfaces may include male and female interfaces that mechanically and electrically couple at least one wire coupled to each of the male and female interfaces. The coupling of the male and female interfaces may be temporary, may use a tool for assembly and removal, or may serve as a permanent electrical joint between the at least two wires or between the devices. Further, the electrical interfaces may be manufactured to carry power, signals, control applications, or combinations thereof.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
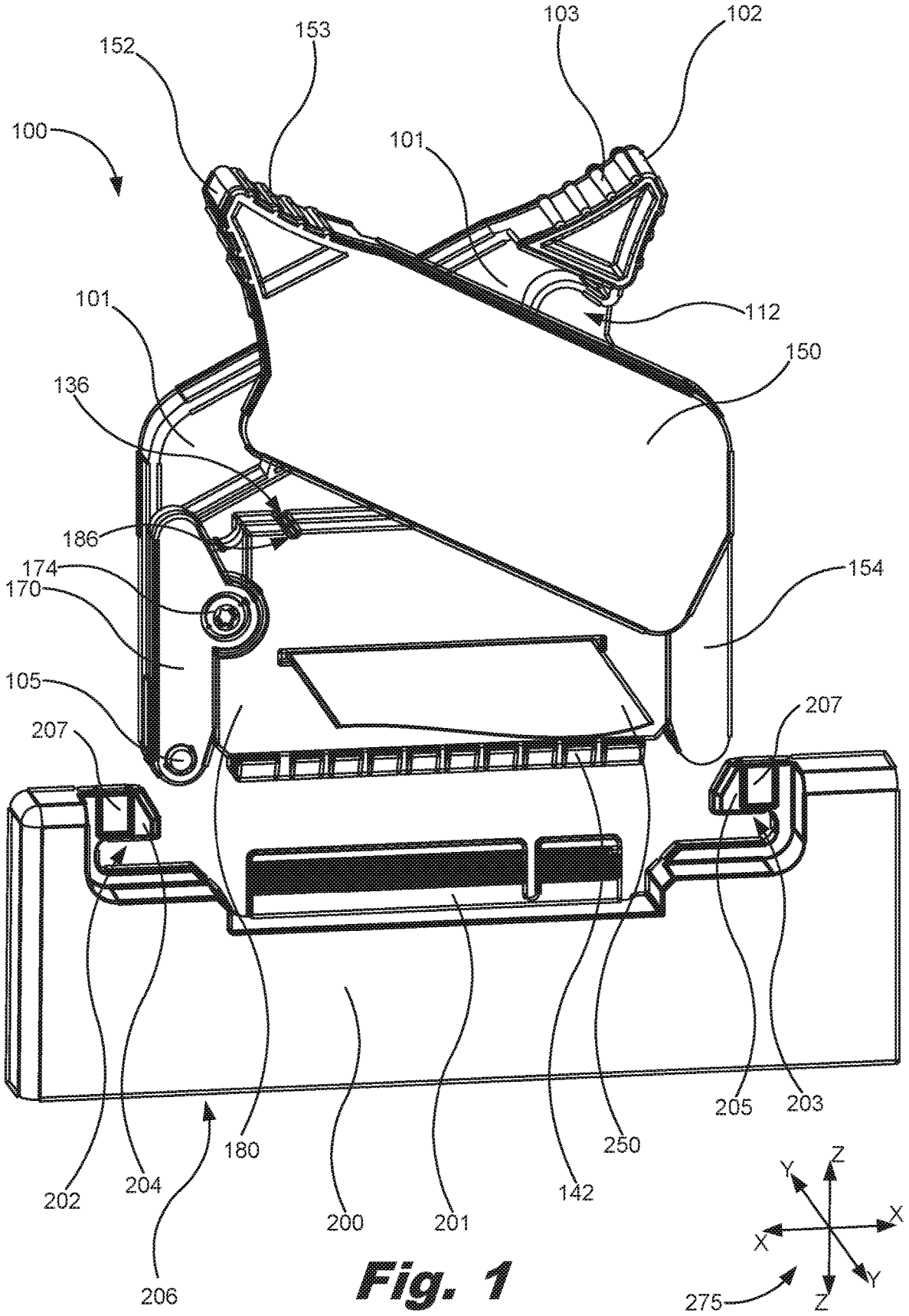
FIG. 1 is an isometric view of an electrical interface system in an uncoupled state, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

As described above, electrical interfaces may include male and female interfaces that mechanically and electrically couple at least one wire coupled to each of the male and female interfaces. For example, edge connectors are the portion of a printed circuit board (PCB) that include a number of traces leading to the edge of the PCB that plug into a matching socket. An edge connector reduces costs in manufacturing an electrical interface because it utilizes a single discrete female portion of the connector with the male portion of the connector being formed out of the edge of the PCB. Further, edge connectors also tend to be fairly robust and durable.

Edge connectors may be used in, for example, a printing device such as a three-dimensional (3D) additive manufacturing apparatus, to electrically and/or communicatively couple a material ejection device such as a printhead, print bar, or pen to the data processing hardware and/or power sources used to drive the pen. In some situations, such as in a 3D additive manufacturing apparatus, the material ejection device may be suspended above a print zone where the material ejection device deposits materials used in a 3D additive manufacturing process. The material ejection device may be suspended using a carriage that moves the material ejection device across the width and height of the print zone. The carriage may be supported by a number of bearings and other support devices that support the carriage and the material ejection device.

In this example, when as user seeks to couple the female portion of an edge connector to a male portion of the edge connector electrically and mechanically to the material ejection device, the user may not properly align the female portion of the connector to the male portion of the connector. This may lead to damage to the edge connector. Further, the user may not be able to visually confirm that the edge connector is connected to the material ejection device, and may use more force than necessary to couple the male and female portions. This increase in force by the user on the electrical interface, in turn, places additional force on the underlying structures including, for example, a carriage system, a bearing system, or other structures used to support the material ejection device. Still, further, the user may not have tactile confirmation that the female portion of the edge connector is properly coupled and seated to the male portion, and may increase the force on the female portion of the edge connector for this reason as well. Thus, in some situations including consumer applications, the forces used to couple the female and male portions of the edge card connector may exceed ergonomic limits, and the applied forces may easily outstrip the connector's ability to safely withstand those forces as well as the underlying system's and structures' ability to withstand those forces.

The present specification describes a fluid ejection device, in an example, that includes a housing with the housing including a plurality of lateral hooks to engage with a plurality of posts of a connector, the lateral hooks running, at least partially, parallel to a cable receiving surface wherein a portion of a printed circuit board (PCB) comprising electrical interconnects extends beyond the cable receiving surface to interface with the connector.

The present specification further describes a housing that includes a plurality of lateral hooks to engage with a plurality of posts of a connector, the lateral hooks running, at least partially, parallel to a cable receiving surface wherein a portion of the printed circuit board comprising electrical interconnects extends beyond at least a portion of the cable receiving surface to interface with the connector.

Additionally, the present specification describes a fluid ejection module that includes a number of fluid ejection dies and a housing with the housing including a plurality of lateral hooks to engage with a plurality of posts of a connector, the lateral hooks running, at least partially, parallel to a cable receiving surface wherein a portion of a printed circuit board (PCB) comprising electrical interconnects extends beyond the cable receiving surface to interface with the connector.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Figure 2:
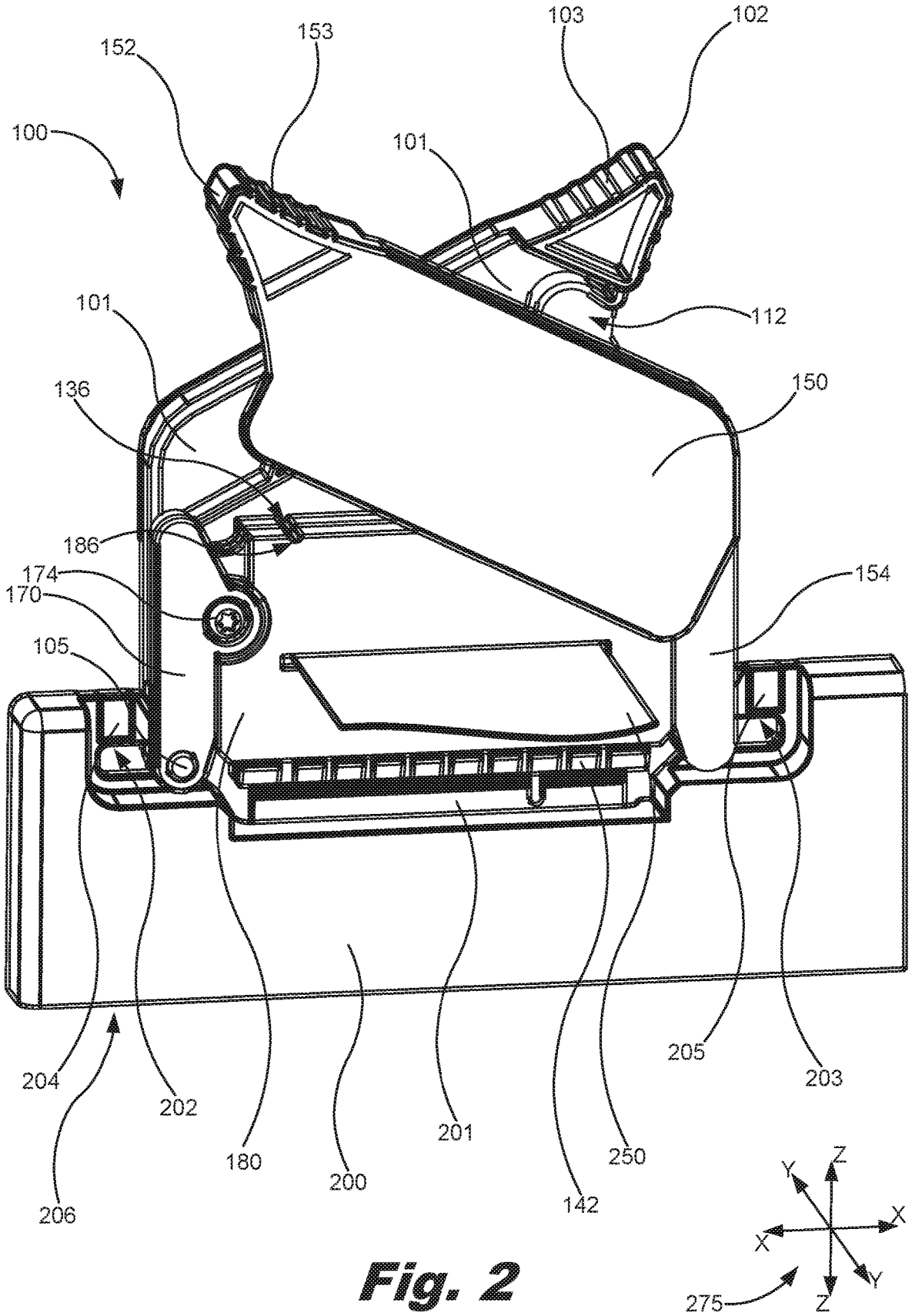
FIG. 2 is an isometric view of an electrical interface system in an intermediate state between an uncoupled state and a coupled state, according to an example of the principles described herein.
Figure 3:
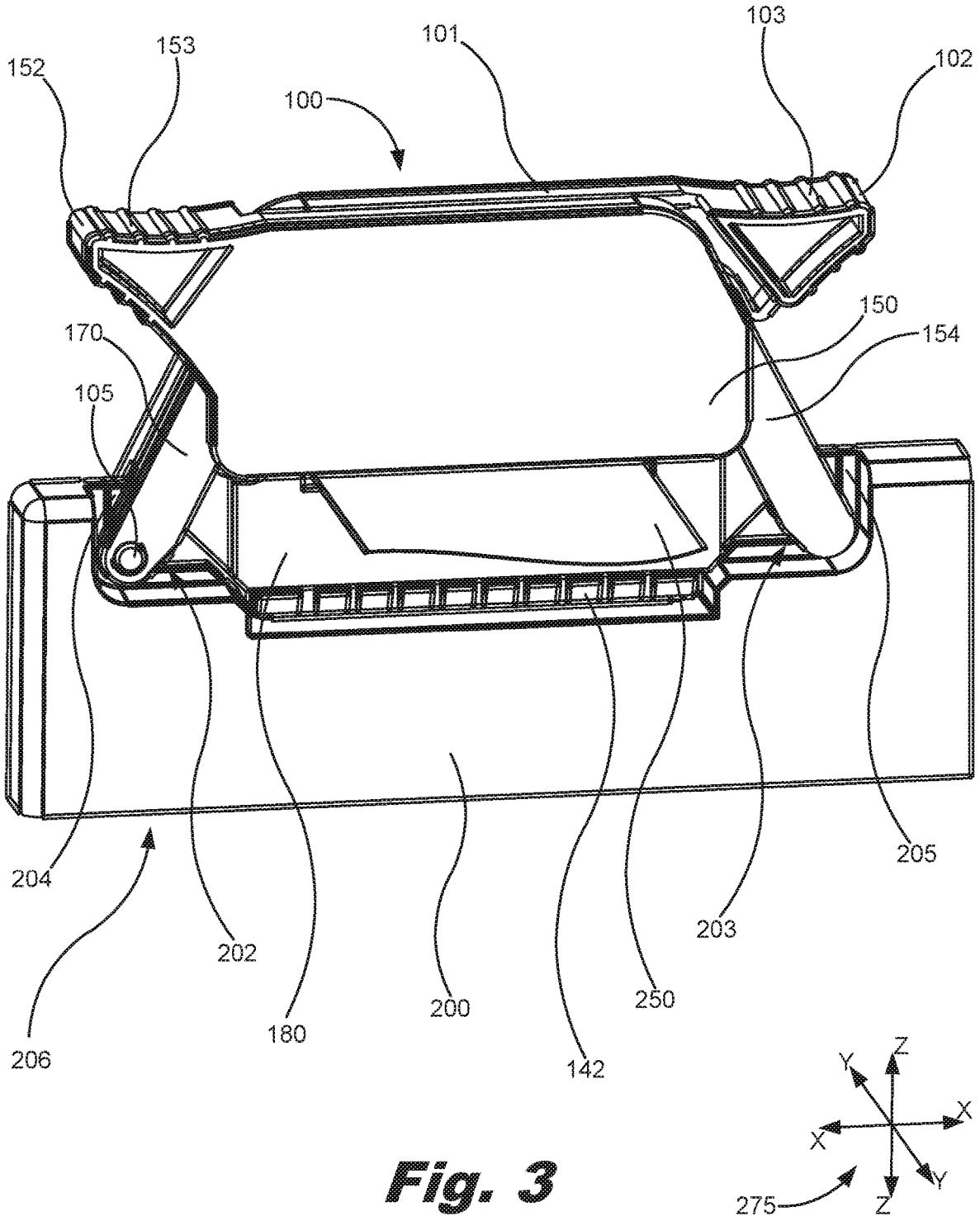
FIG. 3 is an isometric view of an electrical interface system in a coupled state, according to an example of the principles described herein.

Turning now to the figures, FIG. 1 is an isometric view of an electrical interface system in an uncoupled state, according to an example of the principles described herein. Further, FIG. 2 is an isometric view of the electrical interface system of FIG. 1 in an intermediate state between an uncoupled state and a coupled state, according to an example of the principles described herein. Still further, FIG. 3 is an isometric view of the electrical interface system of FIGS. 1 and 2, in a coupled state, according to an example of the principles described herein. The electrical interface system may include a camlock connector (100) including one half of the electrical interface system, and a base (200) including the other half of the electrical interface system to which the camlock connector (100) couples. In the examples described herein, the camlock connector (100) includes a female portion of an electrical interface, and the base (200) includes a male portion of the interface. However, in one example, the camlock connector (100) may include the male portion of the electrical interface, and the base (200) may include the female portion of the electrical interface. Further, in the examples described herein, the base (200) and camlock connector (100) include an edge connector (201) and its mating female interface (142), respectively. An edge connector (201) may be any portion of a printed circuit board (PCB) that includes a number of traces leading to the edge of the PCB that are intended to plug into a matching socket of the mating female interface (142). However, any type of electrical interface may be integrated into the camlock connector (100) and base (200).

As depicted in the series of FIGS. 1 through 3, the camlock connector (100) is coupled to the base (200) by bringing the camlock connector (100) into an initial position as depicted in FIG. 1. In the state depicted in FIG. 1, the camlock connector (100) is not touching any portion of a housing (206) of the base (200). In this state, the user provides a general alignment of the camlock connector (100) relative to the base (200). In FIG. 2, however, the camlock connector (100) is seated on a portion of the housing (206) of the base (200) but is not engaged with the base (200). This engagement is achieved by the user moving the camlock connector (100) in the downward z-direction as indicated by the coordinate indicator (275). With the camlock connector (100) seated on the portion of the housing (206) of the base (200), alignment is achieved by use of posts (105, 155), arms (104, 154), cam levers (120, 170), and other elements of the camlock connector (100) that align with elements of a housing (206) of the base (200).

In FIG. 3, the camlock connector (100) is actuated such that the camlock connector (100) is engaged with and coupled to the base (200). In one example, the camlock connector (100) couples to the base (200) by movement of the posts (105, 155), arms (104, 154), cam levers (120, 170), and other elements of the camlock connector (100) outwards in the x-direction as indicated in by the coordinate indicator (275). This movement causes the posts (105, 155) to engage with corresponding lateral hooks (201, 208) defining lateral voids (202, 203) defined in the housing (206) of the base (200). In an example, the number of hooks (201, 208) formed into the housing (206) of the base (200) due to the inclusion of the lateral voids (202, 203) provide a structure around the posts (105, 155) that secure the posts (105, 155) to the base (200). More details regarding the structure and functioning of the camlock connector (100) will now be provided in connection with the description of FIG. 4 along with FIGS. 1 through 3.

In an example, a number of pads (207) may be formed onto the hooks (201, 208) in order to form an engineering or location fit between the hooks (201, 208) and the connector (100). Additionally, the surfaces formed by the lateral voids (202, 203) and the lateral hooks (201, 208) may serve as guides that guide a number of posts of the connector (100) through the lateral voids (202, 203) when the connector is engaged with the PCB. The connector (100) is fully engaged when a number of posts of the connector (100) seat into an end point of the lateral voids (202, 203).

Figure 4:
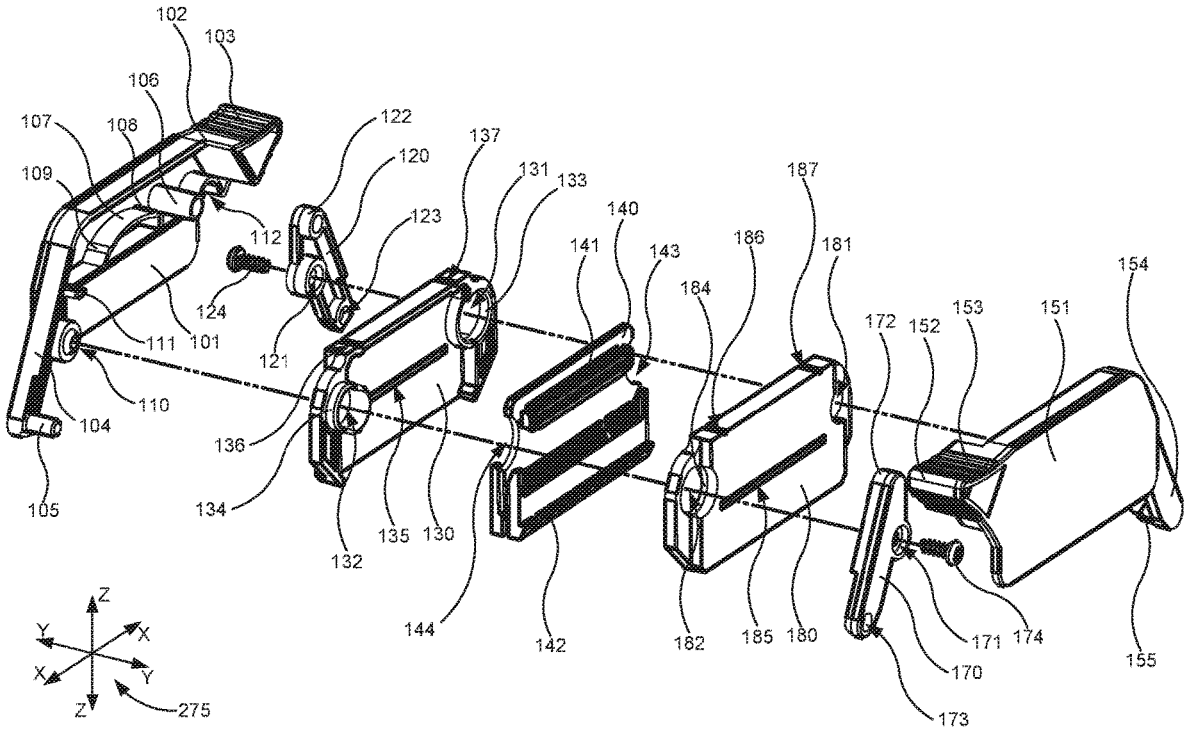
FIG. 4 is an exploded, isometric view of an electrical interface, according to an example of the principles described herein.

FIG. 4 is an exploded, isometric view of an electrical interface, according to an example of the principles described herein. Specifically, FIG. 4 depicts the various elements of the camlock connector (100). In one example, the camlock connector (100) may include a number of identical or near identical parts that are coupled to one another in opposite orientations. These identical or near identical parts are reverse-mirror images of one another. Using these identical or near identical, but reverse-mirror image parts that couple to one another decreases the costs associated with manufacturing since fewer unique parts are manufactured. These identical or nearly identical parts fit together or couple to one another in a complimentary manner to form the camlock connector (100). For example, and to begin describing the elements of the camlock connector (100) of FIG. 4, the camlock connector (100) may include two handles (101, 151). The first handle (101) is an identical part with respect to the second handle (151), but is oriented in an opposite direction with respect to the second handle (151). Several other elements of the camlock connector (100) are arranged as reverse-mirror image parts, and these elements are described herein. Thus, throughout the description of FIG. 4, those elements depicted in the interior portion of the left handle (101) are included in the right handle (151), but are not depicted in FIG. 4.

Each of the handles (101, 151) may include a knob (102, 152) with which a user uses to apply force on the handles (101, 151). The force may be applied in the z-direction as indicated by the coordinate indicator (275), and this force, as is described herein, results in the movement of the handles (101, 151) in the z-direction, and the coupling of the camlock connector (100) to the base (200). On one example, the knobs (102, 152) may include knurling (103, 153) to allow the user to apply relatively more force on the handles (101, 151) using the increased frictional forces between the user's fingers or hand and the handles (101, 151) of the camlock connector (100) than may be provided by the otherwise smooth surface. In one example, the knurling (103, 153) may be located on both an upper side of the knobs (102, 152) as well as an underside of the knobs (102, 152) in order to allow as user to better grip the knobs (102, 152) to both engage and disengage the camlock connector (100).

Each of the handles (101, 151) also includes an arm (104, 154) that extends away from a main body of the handle (101, 151). Each arm (104, 154) includes a post (105, 155) formed thereon or coupled thereto. Each post (104, 154) protrudes in a direction perpendicular to the direction of extension of its corresponding arm (104, 154) and in a direction perpendicular to the hooks (201, 208) formed from the base (200). This allows the posts (105, 155) to be moved into the lateral voids (202, 203) defined in the base (200) and engage with the hooks (201, 208). The engagement of the posts (105, 155) in this manner results in the coupling of the camlock connector (100) to the base (200) and, in turn, the coupling of the female interface (142) of the camlock connector (100) to the male edge connector (201) of the base (200).

The camlock connector (100) may further include a first (130) and a second (180) housing. The connector housings (130, 180) are used to house a printed circuit assembly (PCA) (140). The connector housings (130, 180), when coupled around the PCA (140), provide a number of conduits to be defined therethrough by a number of first (132, 181) and second (131, 182) apertures defined therein. A number of fasteners (124, 174) may extend through the first (132, 181) and second (131, 182) apertures to couple the various elements of the camlock connector (100) together. In one example, the first apertures (132, 181) may be formed differently with respect to the second apertures (131, 182) such that a first interior ring (134) formed around the first apertures (132, 181) is smaller relative to a second interior ring (133) formed around the second apertures (131, 182). In this manner, the first interior ring (134) is able to fit within the corresponding second interior ring (133) such that their fit is a mating fit. Thus, when the connector housings (130, 180) are coupled together, the first interior ring (134) mates with the second interior ring (133). In one example, the first interior ring (134) mates with the second interior ring (133) using an interference fit, a press fit, a friction fit, or any other engineering fit that causes the first interior ring (134) to couple to the second interior ring (133).

A third aperture (135, 185) may be defined in the connector housings (130, 180). This third aperture (135, 185) is located in a middle portion of each of the connector housings (130, 180), and is dimensioned to allow a number of cables such as a ribbon cable (250) to couple to an interface of the PCA (140) through the third aperture (135, 185) of the housing (130, 180). As with other elements in the camlock connector (100), the connector housings (130, 180) may be manufactured as reverse-mirror images of one another such that both connector housings (130, 180) include a third aperture (135, 185) defined therein even when one of the two third apertures (135, 185) may not be used. Again, this reduces costs associated with an otherwise relatively more expensive and more complicated design of two separate and unique connector housings (130, 180).

The PCA (140) includes a ribbon cable interface (141) electrically coupled through the PCA (140) to a female interface (142). The ribbon cable interface (141) may be any interface that accepts a multi-wire planar cable that includes a plurality of conducting wires running parallel to each other on the same flat plane. In this manner, the ribbon cable (250) that couples to the ribbon cable interface (141) may do so via the flat third aperture (135, 185) defined in the housing (130, 180). In this manner, the female interface (142) is electrically coupled to a ribbon cable (250) through the PCA (140) and ribbon cable interface (141).

The PCA (140) may include any shape that allows the PCA (140) to fit within the connector housings (130, 180). For example, a recess (143, 144) may be defined within the PCA (140) at a point at which the first interior ring (134) and second interior ring (133) mate in order to provide space for the coupling of the connector housings (130, 180) together around the PCS (140).

A cam lever (120, 170) may be included between each handle (101, 151) and housing (130, 180). The cam levers (120, 170) cause the coaxial rotational movement of the handles (101, 151) to be transformed into the linear movement of the posts (105, 155) into and out of the lateral voids (202, 203), and, at the same time, causes the connector housings (130, 180) and PCA (140) to move in the z-direction to engage and disengage to and from the edge connector (201) of the base (200). In order to achieve these purposes, the cam levers (120, 170) are coupled to handles (101, 151) on respective opposite sides therefrom using the fasteners (124, 174). Each cam lever (120, 170) include a fastener conduit (121) through which the respective fastener (124, 174) Is threaded into a fastener anchor point (110) located on each of the handles (101, 151). In this manner, the connector housings (130, 180) and PCA (140) are rotationally coupled to the handles (101, 151). The fastener conduits (121) rotate within the first (132, 181) and second (131, 182) apertures defined in the connector housings (130, 180).

Each cam lever (120, 170) includes a post aperture (123, 173) that engages with the posts (105, 155) of the handles (101, 151) to which the cam lever (120, 170) is coupled to using the fasteners (124, 174), respectively. The posts (105, 155) fit within the post apertures (123, 173), and a space is created between each of the arms (104, 154) and the cam levers (120, 170) to allow the posts (105, 155) to enter the corresponding lateral voids (202, 203) defined in the base (200) while the arms (104, 154) and the cam levers (120, 170) move past the hooks (201, 208) as depicted in, for example, FIG. 3. Stated another way, the arms (104, 154) and the cam levers (120, 170) are offset from one another such that the hooks (201, 208) may be inserted therebetween as the camlock connector (100) couples to the base (200).

The cam levers (120, 170) include a buttress end (122, 172) that seats within a buttress recess (112) defined within each of the handles (101, 151) when the camlock connector (100) is engages with the base (200) as depicted in FIG. 3. The buttress ends (122, 172) seat within the buttress recess (112) to stop the rotation of the handles (101, 151). In a similar manner, a number of protrusions (111) formed on or coupled to the handles (101, 151) seat within a number of protrusion recesses (136, 137, 186, 187) defined in the first (130) and a second (180) connector housings. The seating of the protrusions (111) within the protrusion recesses (136, 137, 186, 187) also serves to stop the rotation of the handles (101, 151) at the point at which the camlock connector (100) is in the state depicted in FIG. 3.

Each handle (101, 151) includes a number of elements that assist in the incremental rotation of the handles (101, 151) about parallel axis. The handles (101, 151) each rotate about a center defined by an arched track (107). A registration pillar (106) is included on the interior of each handle (101, 151) adjacent the arched track (107). When the elements of the camlock connector (100) are coupled together as depicted in FIGS. 1 through 3, the registration pillar (106) of the first handle (101) interfaces with the arched track (107) included on the second handle (151), and the registration pillar (106) of the second handle (151) interfaces with the arched track (107) included on the first handle (101). A number of protrusions (108, 109) are formed or otherwise included on the outer surface of the arched track (107). The protrusions (108, 109) act as stops such that as the registration pillars (106) move along the surface of the arched tracks (107), additional force is applied to cause the registration pillars (106) to move over the profiles of the protrusions (108, 109). The arched track (107), registration pillars (106), and protrusions (108, 109) are positioned and dimensioned such that once the registration pillars (106) are moved over the protrusions (108, 109), the registration pillars (106) will not move back over the protrusions (108, 109) without additional force being applied. In this manner, the handles (101, 151) are able to remain in a disengaged state as depicted in FIGS. 1 and 2 or an engaged state as depicted in FIG. 3 using the protrusions (108, 109). Any number of protrusions (108, 109) may be included on the arched track (107) to provide discrete stop positions along the rotational motion of the handles (101, 151). However, at least two protrusions (108, 109) as depicted in FIG. 4 are included in order to stop the movement of the handles (101, 151) between a fully disengaged state and a fully engaged state.

The interaction between the registration pillars (106) and the protrusions (108, 109) on the arched track (107) provide haptic feedback to a user as to when the camlock connector (100) is in an engaged or disengaged state. As the registration pillars (106) move over the profiles of the protrusions (108, 109), a user can feel the change in forces between the registration pillars (106) and the protrusions (108, 109), and can appreciate the engagement and disengagement points of the camlock connector (100).

Further, the arched tracks (107) and the engagement of the registration pillars (106) with the opposite side's arched track (107) results in the synchronized movement of the handles (101, 151) since one registration pillar (106) of the first handle (101) is located along the same portion of the arched track (107) of the second handle (151) as is the other registration pillar (106) of the second handle (151) is with respect to the arched track (107) of the first handle (101). Using this synchronization of the movement of the handles, a user may be able to visually confirm when the camlock connector (100) is engaged and disengaged by viewing whether or not the handles (101, 151) are or are not parallel with one another as depicted in FIG. 3. Further, in one example, force may be applied to a single handle (101, 151) and not the other to engage or disengage the camlock connector (100).

Using FIGS. 1 through 4, the function of the camlock connector (100) will now be described. The user may bring the camlock connector (100) into general alignment with the housing (206) of the base (200) as depicted in FIG. 1. The camlock connector (100) may then be lowered in the z-direction such that the posts (105, 155) touch or rest on a top surface of the housing (206) of the base (200). This surface may include an interior side of the lateral voids (202, 203) defined in the housing (206) of the base (200) as depicted in FIG. 2.

The user may then apply force on the knobs (102, 152) of the handles (101, 151) in the z-direction. Doing so causes the registration pillars (106) to move past the first protrusion (108), along the arched track (107), and past the second protrusion (109). Simultaneously, the posts (105, 155) are moved away from the center of the camlock connector (100) and into their respective lateral voids (202, 203) defined in the housing (206) of the base and in the positive and negative x-directions. The cam levers (120, 170) force the connector housings (130, 180) and the PCA (140) contained therein downward in the z-direction. In this manner, the user does not directly apply a force in coupling the female interface (142) to the edge connector (201). Instead, the rotational motion of the handles (101, 151) is converted into linear, z-directional motion in the connector housings (130, 180) and the PCA (140) via the cam levers (120, 170). The action of the cam levers (120, 170) ensures that the user cannot apply too much force onto the interface between the female interface (142) to the edge connector (201) within the housing (206), and the buttress ends (122, 172), buttress recesses (112), protrusions (111), and protrusion recesses (136, 137, 186, 187) keep the user from being able to apply too much force on the handles (101, 151) and over-rotating the handles (101, 151).

In order to disconnect the camlock connector (100) from the base (200), the user may apply force on the underside of the knobs (102, 152), and the mechanical actuation of the various elements of the camlock connector (100) occur in the opposite order as described above. Thus, the camlock connector (100) may be removed from and re-engaged with the base (200) any number of times.

Figure 5:
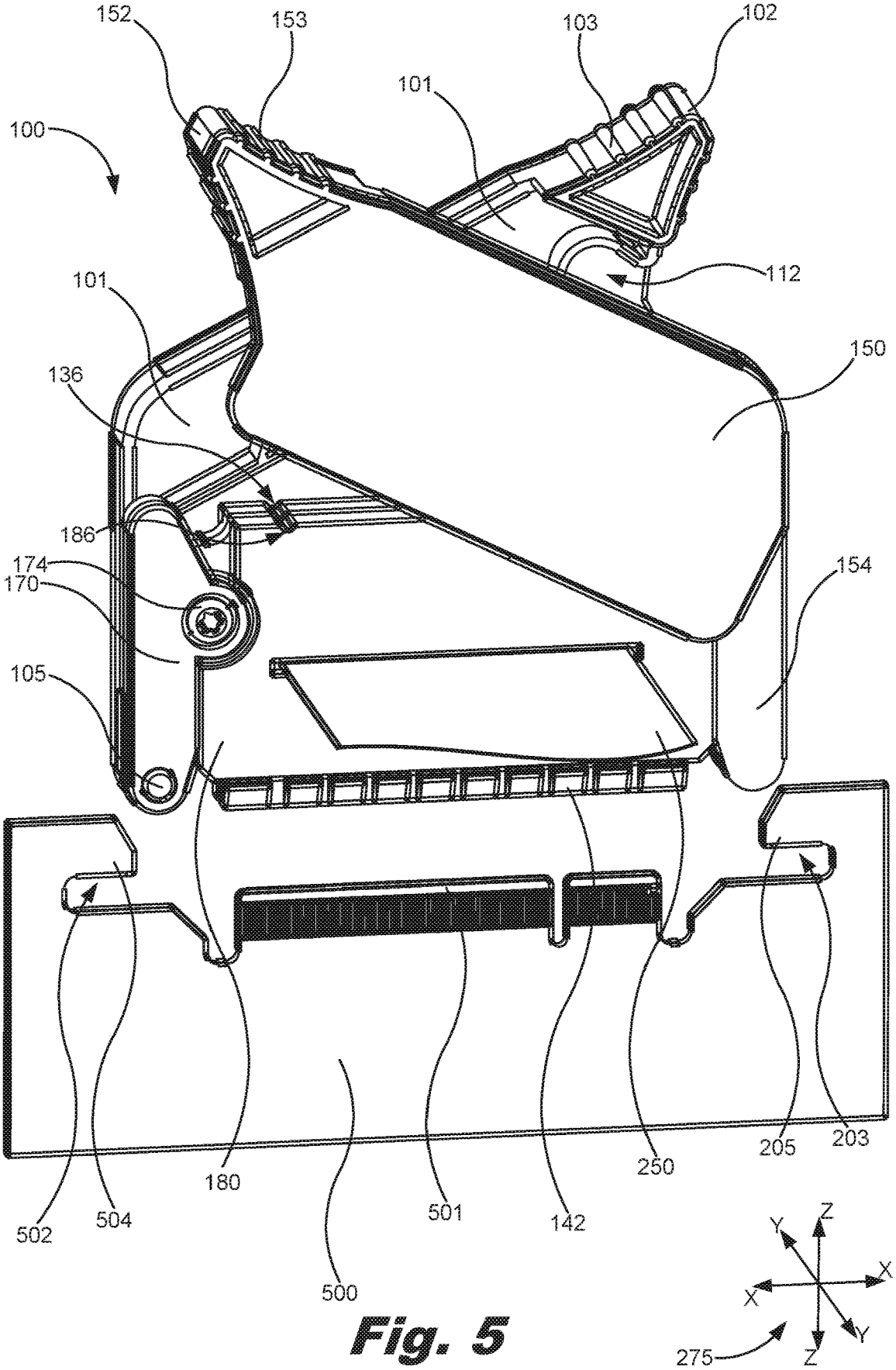
FIG. 5 is an isometric view of an electrical interface system in an uncoupled state, according to another example of the principles described herein.

FIG. 5 is an isometric view of an electrical interface system in an uncoupled state, according to another example of the principles described herein. The electrical interface system of FIG. 5 includes similar elements as compared to the examples depicted and described in relation to FIGS. 1 through 4, including, for example, the camlock connector (100) and the edge connector (201). Therefore, the description of similar elements between FIGS. 1 through 4 and 5 are provided above.

The example of FIG. 5 includes a printed circuit board (PCB) (500) in which a number of hooks (504, 505) and lateral voids (202, 203) are formed and defined within the PCB (500) itself instead of in a housing (206) defined around the PCB. In this example, the camlock connector (100) engages with the hooks (504, 505) via the posts (105, 155) engaging with the lateral voids (502, 503). The example of FIG. 5 includes less parts such as a housing (206) surrounding the edge connector (201). This reduction in the number of parts results in a less expensive electrical interface, but may be relatively less robust than the examples where the housing (206) was implemented.

Figure 6:
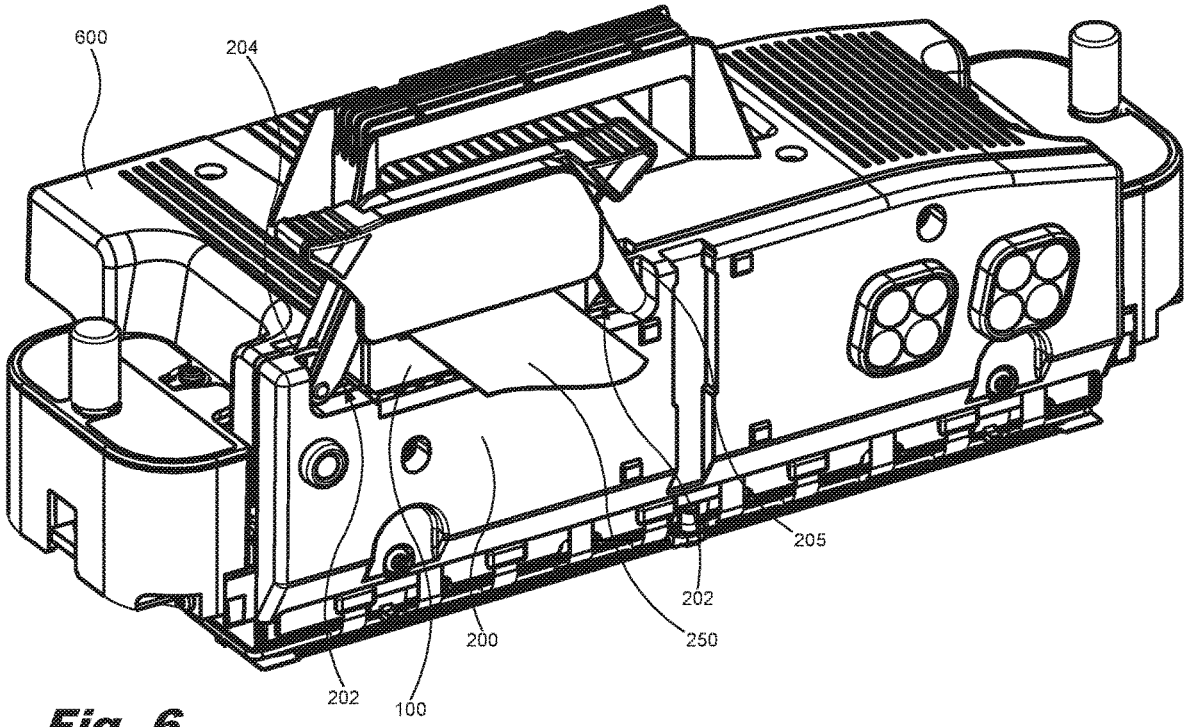
FIG. 6 is an isometric view of an electrical interface system incorporated into a printhead, according to another example of the principles described herein.

FIG. 6 is an isometric view of an electrical interface system incorporated into a printhead (600), according to another example of the principles described herein. The printhead (600) may be any device that ejects a fluid. The printhead (600) may be used in any fluid ejection device used to form two-dimensional images or three-dimensional objects. The electrical interface includes the camlock connector (100) and base (200) with the housing (206) housing both parts of the printhead (600) and the PCB described herein. The base (200) is mechanically integrated into the side of the printhead (600) to allow the camlock connector (100) to couple to the base (200), and provide electrical signals to be sent to the printhead (600) through the ribbon cable (250) and camlock connector (100).

The printhead (600) may be a replaceable element within a printing system such as a 3D printing device, and may use the camlock connector (100) and base (200) to selectively connect to and disconnect from a number of printheads (600) as they are replaced. Use of the camlock connector (100) and base (200) in connection with a printhead (600) ensures that a user does not compromise the integrity of supporting structures like carriages and bearings that support the printhead (600). A user may otherwise exert too much force on the electrical interface causing damage to the underlying support structures. The present camlock connector (100) and base (200) remove the application of direct force on the electrical interface. Although a printhead (600) is depicted in FIG. 6 as the receiving device, any device that has underlying structures that may be damaged through the application of too much force may benefit from the camlock connector (100).

Figure 7:
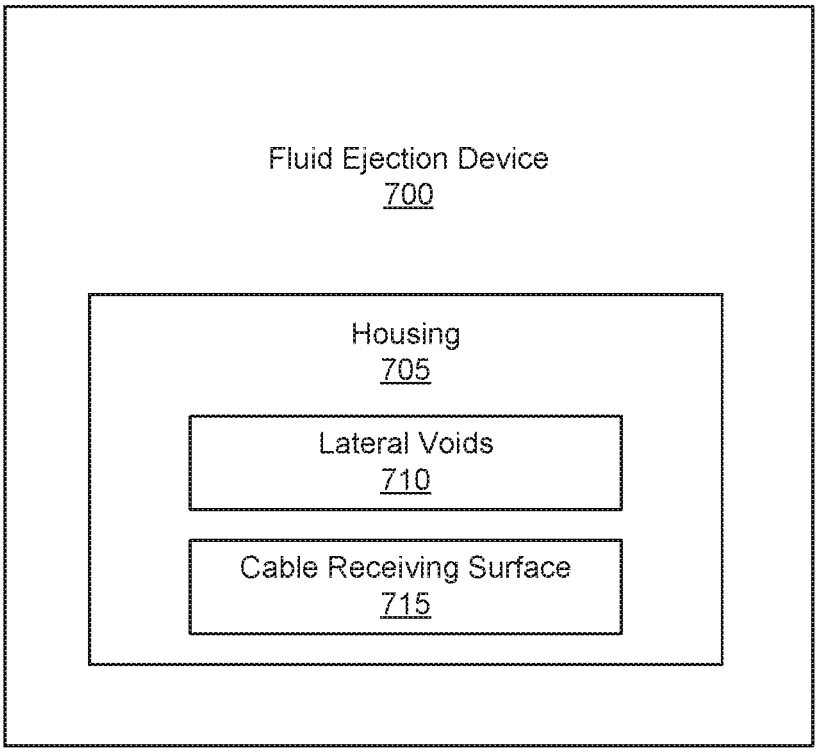
FIG. 7 is a block diagram of a fluid ejection device including the housing of FIGS. 1 through 4 according to an example of the principles described herein.

FIG. 7 is a block diagram of a fluid ejection device (700) including the housing (705) of FIGS. 1 through 4 according to an example of the principles described herein. The fluid ejection device (700) includes a housing (705) that houses, at least, a portion of a PCB as described herein. The housing (705) may be similar to the housings described herein in connection with FIGS. 1-6. Defined in the housing (705) are a number of lateral hooks (710) that receive a plurality of posts of a connector. The lateral hooks (710) run, at least partially, parallel to a cable receiving surface of the housing (705) such that movement of the posts along a direction parallel to the cable receiving surface causes the connector to engage with the housing (705) and the PCB. In an example, a portion of the printed circuit board (PCB) comprising a number of electrical interconnects may extend beyond the cable receiving surface so as to interface with the connector during engagement.

In an example, the fluid ejection device (700) is a 3D additive manufacturing apparatus. The 3D additive manufacturing apparatus may include a material ejection device (600) such as the printhead of FIG. 6. The material ejection device (600) ejects material such as build materials onto a substrate or build platform.

The 3D additive manufacturing apparatus may also include an electrical interface system to electrically couple the material ejection device (600) to control circuitry of the 3D additive manufacturing apparatus. The electrical interface system may include a mechanical fastener (100) such as the camlock connector (100) depicted in FIGS. 1 through 6. The mechanical fastener (100) may include a first handle (101), a second handle (151). The first handle (101) and second handle (151) are located on opposite sides of the mechanical fastener (100). Further, the first handle (101) and second handle (151) pivoting in opposite directions with respect to one another as they are actuated.

The mechanical fastener (100) may also include a first housing (130) and a second housing (180) coupled to the first housing. A first electrical interface (140) is housed in the mechanical fastener (100) between the first (130) and second (180) housings. A first lever (120) is located between the first handle (101) and the first housing (130), and is mechanically coupled to the second handle (151) using, for example, a fastener (124). Similarly, a second lever (170) is located between the second handle (151) and the second housing (180). The second lever (170) is mechanically coupled to the first handle (101). The mechanical fastener (100) may also include a first post (105) coupled to the first handle (101) and the second lever (170). A second post (155) is coupled to the second handle (151) and the first lever (120).

The electrical interface system may also include a number of lateral voids (202, 203) defined in a cable receiving surface (715) of a housing (206) of the material ejection device (600) to which the mechanical fastener (100) couples. As described above, the lateral voids (202, 203) are defined in the housing (206) of the material ejection device (600) such that a number of hooks (201, 208) are formed from the housing of the material ejection device (600) such as the base (200) described herein.

In one example, the lateral voids include a first lateral void (202) defined by a first hook (201) within a coupling structure of the material ejection device (600) to which the mechanical fastener (100) couples. Further, a second lateral void (203) may be defined by a second hook (208) defined within the coupling structure opposite from the first lateral void (202) with respect to a second electrical interface (201) of the coupling structure. Actuation of the mechanical fastener (100) simultaneously causes the first (105) and second (155) posts to engage the first (202) and second (203) lateral voids and the first electrical interface (140) to engage with the second electrical interface (201). In one example, the first electrical interface (140) and second electrical interface (201) may include peripheral component interconnect express (PCIe) edge card electrical interfaces. Further, in one example, the coupling structure is coupled to a print bar.

Figure 8:
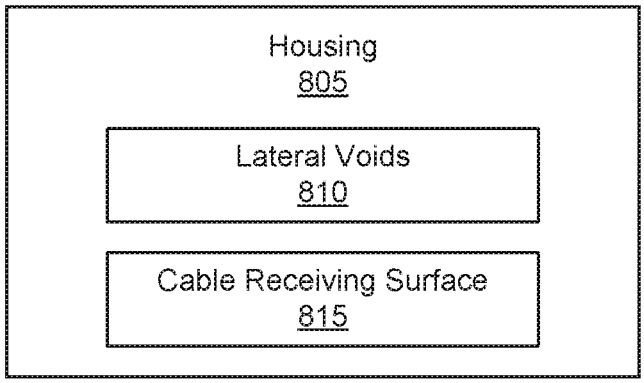
FIG. 8 is a block diagram of a housing according to an example of the principles described herein.

FIG. 8 is a block diagram of a housing (800) according to an example of the principles described herein. As described herein, the housing (800) may include a number of lateral hooks (810) and a cable receiving surface (815). Again, the number of lateral hooks engage a plurality of posts of a connector. Additionally, the lateral voids (810) run, at least partially, parallel to a cable receiving surface. Further a portion of the printed circuit board comprising electrical interconnects extends beyond at least a portion of the cable receiving surface to interface with the connector (100).

Figure 9:
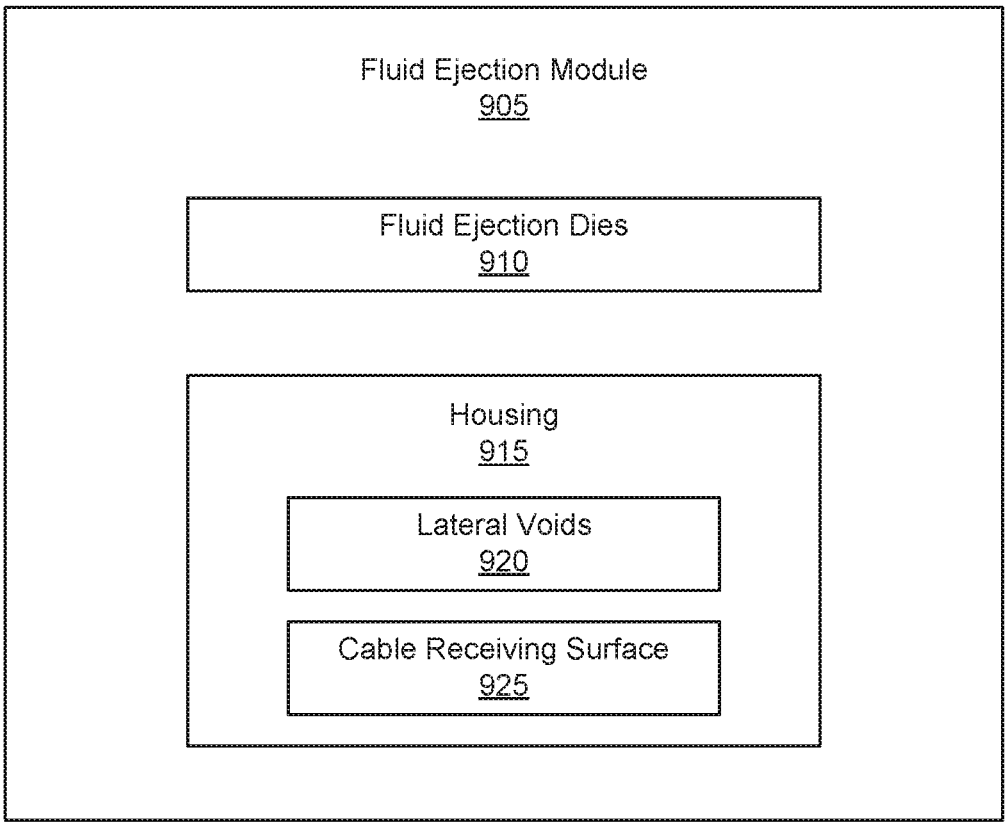
FIG. 9 is a block diagram of a fluid ejection module according to an example of the principles described herein.

FIG. 9 is a block diagram of a fluid ejection module (905) according to an example of the principles described herein. The fluid ejection module (905) may include a housing (915) with its lateral hooks (920) and cable receiving surface (925) as similarly described herein in connection with FIGS. 1-6. Additionally, the fluid ejection module (905) may include a number of fluid ejection dies (910). The fluid ejection dies (910) may incorporate any device that causes a fluid to be ejected from the fluid ejection dies (910). These devices may include piezoelectric devices and thermal ejection devices among other types of devices.

The specification and figures describe a mechanical fastener for an edge card interface may include a first handle and a second handle. The first handle and second handle are located on opposite sides of the mechanical fastener. The mechanical fastener may also include a first housing, a second housing coupled to the first housing, an electrical interface housed in the mechanical fastener between the first and second housings, a first lever intermediary between the first handle and the first housing and mechanically coupled to the second handle, a second lever intermediary between the second handle and the second housing and mechanically coupled to the first handle, a first post coupled to the first handle and the second lever, and a second post coupled to the second handle and the first lever. The mechanical fastener provides a quick, easy, and safe engagement and disengagement of an electrical interface. Further, the mechanical fastener provides tactile feedback to a user that indicates to the user when the electrical interface is completed. Still further, the mechanical fastener provides a hold open and hold closed feature in the interaction between the registration pillars (106), arched tracks (107), and protrusions (108, 109) within the camlock connector (100).

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid ejection device, comprising:

a housing;

a plurality of lateral hooks; and a plurality of lateral voids defined by the plurality of lateral hooks, the lateral voids to receive a plurality of translating posts of a connector, the lateral hooks running, at least partially, parallel to the housing;

wherein:

a portion of a printed circuit board (PCB) comprising electrical interconnects extends beyond the housing to interface with the connector; and the plurality of translating posts translate away from a center of the connector responsive to a rotational input on handles of the connector.

2. The fluid ejection device of claim 1, wherein at least a portion of the lateral hooks comprise a number of pads that provide a location fit between the connector and the housing.

3. The fluid ejection device of claim 1, wherein the housing comprises a number of surfaces that guides a number of posts of the connector through lateral voids defined by the lateral hooks when the connector is engaged with the PCB.

4. The fluid ejection device of claim 1, wherein the connector is fully engaged when the number of posts seat into an end point of the lateral voids defined by the lateral hooks.

5. The fluid ejection device of claim 1, wherein the fluid ejection device is a print module comprising a number of fluid ejection dies.

6. The fluid ejection device of claim 1, wherein the fluid ejection device is a 3D additive manufacturing apparatus.

7. The fluid ejection device of claim 1, wherein the plurality of lateral hooks and the plurality of lateral voids are formed in the housing.

8. The fluid ejection device of claim 1, wherein the PCB comprises an edge card interface.

9. The fluid ejection device of claim 8, wherein the edge card interface is a peripheral component interconnect express (PCIe).

10. A housing, comprising:

a plurality of lateral hooks; and a plurality of lateral voids defined by the lateral hooks, the lateral voids to receive a plurality of translating posts of a connector, the lateral hooks running, at least partially, parallel to electrical interconnects of the housing;

wherein:

the translating posts translate parallel to the electrical interconnects and away from a center of the connector responsive to a rotational input on handles of the connector; and a portion of a printed circuit board comprising electrical interconnects extends beyond at least a portion of the housing to interface with the connector.

11. The housing of claim 10, wherein the PCB comprises an edge card interface.

12. The housing of claim 10, wherein a portion of the housing extends out further than the portion of the printed circuit board comprising electrical interconnects.

13. The housing of claim 10, wherein the housing comprises a number of surfaces that guides a number of posts of the connector through lateral voids defined by the lateral hooks when the connector is engaged with the PCB.

14. The housing of claim 13, wherein the connector is fully engaged when the number of posts seat into an end point of the lateral voids defined by the lateral hooks.

15. A fluid ejection module, comprising:

a number of fluid ejection dies; and a housing, the housing comprising:

a plurality of lateral hooks; and a plurality of lateral voids defined by the lateral hooks, the lateral voids to receive a plurality of translating posts of a connector, the lateral hooks running, at least partially, parallel to electrical interconnects of a printed circuit board (PCB);

wherein:

the translating posts translate parallel to the electrical interconnects and away from a center of the connector;

a portion of the PCB comprising electrical interconnects extends beyond a cable receiving surface to interface with the connector; and the plurality of lateral hooks and the plurality of lateral voids are formed in the PCB.

16. The fluid ejection module of claim 15, wherein at least a portion of the lateral hooks comprise a number of pads that provide a location fit between the connector and a printbar housing.

17. The fluid ejection module of claim 15, wherein the translating posts translate away from the center of a connector responsive to actuation of a cam lever to transfer a rotational movement into linear movement of the translating posts.

18. The fluid ejection module of claim 17, wherein responsive to actuation of the cam lever, the posts draw the connector into the housing.

* * * * *